US007168281B2

(12) United States Patent
Koerner et al.

(10) Patent No.: US 7,168,281 B2
(45) Date of Patent: Jan. 30, 2007

(54) METHOD FOR PRODUCING AN ANNULAR ELEMENT COMPRISING AN INNER TOOTHING, ESPECIALLY A SLIDING SLEEVE, AND DEVICE FOR CARRYING OUT THE METHOD

(75) Inventors: Ekkehard Koerner, Goeppingen (DE); Michael Roesemann, Hausach (DE)

(73) Assignee: Neumayer Tekfor GmbH, Hausach (DE)

( * ) Notice: Subject to any disclaimer, the term of this patent is extended or adjusted under 35 U.S.C. 154(b) by 0 days.

(21) Appl. No.: 10/508,878

(22) PCT Filed: Mar. 26, 2003

(86) PCT No.: PCT/DE03/01005

§ 371 (c)(1),
(2), (4) Date: Dec. 22, 2004

(87) PCT Pub. No.: WO03/080271

PCT Pub. Date: Oct. 2, 2003

(65) Prior Publication Data

US 2005/0103083 A1 May 19, 2005

(30) Foreign Application Priority Data

Mar. 26, 2002 (DE) ..... 102 13 509

(51) Int. Cl.
*B21K 1/30* (2006.01)

(52) U.S. Cl. ..... 72/355.4; 29/893.34

(58) Field of Classification Search ..... 72/354.8, 72/355.2, 355.4, 355.6, 377; 29/893.34
See application file for complete search history.

(56) References Cited

FOREIGN PATENT DOCUMENTS

| | | |
|---|---|---|
| DE | 37 18 884 A1 | 12/1988 |
| DE | 198 20 645 A1 | 11/1999 |
| DE | 100 21 189 | 1/2001 |
| EP | 0 322 770 | 7/1989 |
| EP | 1 005 932 | 6/2000 |

*Primary Examiner*—Lowell A. Larson
(74) *Attorney, Agent, or Firm*—Jacobson Holman PLLC

(57) ABSTRACT

A method for producing an annular element having an inner toothing, especially a sliding sleeve. An outlet ring element can be arranged in an extrusion device which includes an annular matrix element with an inner bore hole, a sleeve stamping device which is arranged therein and has first and second annular sleeve stamping elements which can be moved in relation to each other in the inner bore hole, and an inner stamping device having first and second inner stamping elements and first and second partial regions which are interspaced in the circumferential direction. When the inner stamping device is closed, the partial regions form cavities for producing the inner toothing. The outlet ring element is arranged between the first and second inner stamping elements and is measured in such a way that when closing the sleeve stamping device, material from the outlet ring element flows into the cavities for the formation of the inner toothing.

15 Claims, 4 Drawing Sheets

METHOD FOR PRODUCING AN ANNULAR ELEMENT COMPRISING AN INNER TOOTHING, ESPECIALLY A SLIDING SLEEVE, AND DEVICE FOR CARRYING OUT THE METHOD

This is a nationalization of PCT/DE03/01005 filed Mar. 26, 2003 and published in German.

BACKGROUND OF THE INVENTION

1. Field of the Invention

The present invention relates to a method for producing an annular element comprising an inner toothing, especially a sliding sleeve wherein an outlet ring element can be arranged in an extrusion device.

2. Desscription of the Related Art

DE 198 20 645 A1 discloses a method in which the sleeve body of a sliding sleeve is manufactured in one piece in a non-cutting process from sheet metal with one break at the outer perimeter and with an inner toothing at the inner perimeter. The gear shift fork guide is in the form of two rings that are affixed at the break. One problem with such a production method consists in the fact that the design process is comparatively complex and therefore expensive. The same is also true of prior arts of metal-cutting manufacturing methods.

SUMMARY OF THE INVENTION

The task of the present invention consists of creating a method that enables the relatively simple and therefore inexpensive production of an annular element with inner toothing, especially a sliding sleeve.

This task is solved by a method according to the present invention for producing an annular element comprising an inner toothing, especially a sliding sleeve, wherein an outlet ring element can be arranged in an extrusion device which includes an annular matrix element with an inner bore hole, a sleeve stamping device which is arranged therein having a first and a second annular sleeve stamping element which can be moved in relation to each other in the inner bore hole, and an inner stamping device having a first and a second inner stamping element and first and second partial regions which are interspaced in the circumferential direction. When the inner stamping device is closed, the partial regions form cavities for producing the inner toothing. The outlet ring element is arranged between the first and second inner stamping elements and is measured in such a way that when closing the sleeve stamping device, material from the outlet ring element flows into the cavities for the formation of the inner toothing.

The main advantage therefore consists in that the method according to the present invention enables the production of annular elements with an inner toothing, especially that of sliding sleeves, by means of lateral extrusion. In one advantageous embodiment the straight-cut toothings as well as the laterally adjacent roof-shaped toothings of the inner toothing. Complex process steps required for the production of such annular elements with inner toothing by means of rolling (separate steps for the production of straight-cut toothing and roof-shaped toothing) could therefore be eliminated. In the same way the known and disadvantageous process steps of a non-cutting technology are not required.

One advantage of the method according to the present invention is the fact that the lateral extrusion can take place automatically on an appropriately designed lateral extrusion device equipped with the appropriately dimensioned outlet ring element.

In one embodiment of the present invention, undercuts are produced in the inner toothing using an additional extrusion device, as they are commonly found for instance in sliding sleeves. These undercuts are comparatively simple to make and can also be produced automatically.

Advantageous embodiments of the invention arise from the subordinate claims.

BRIEF DESCRIPTION OF THE DRAWINGS

The inventions and their embodiments are explained in more detail below in connection with the following figures, in which.

DETAILED DESCRIPTION OF THE PREFERRED EMBODIMENTS

Figure 1:
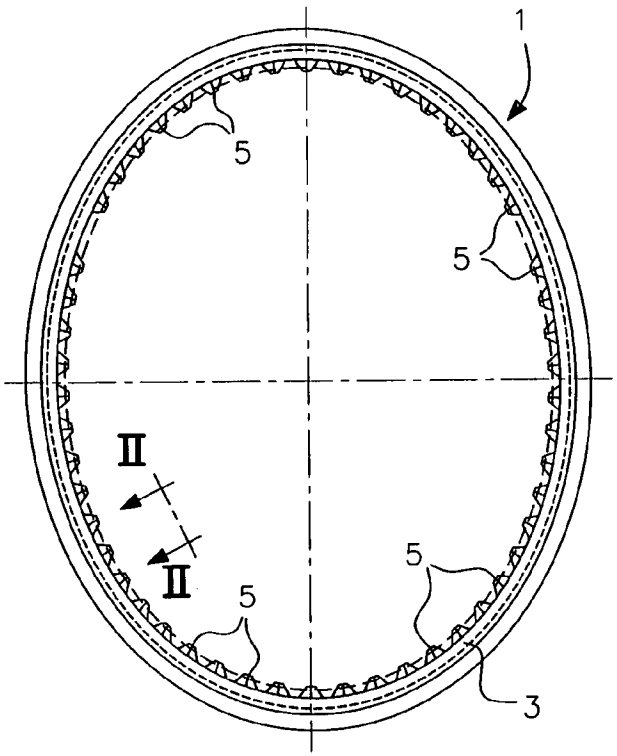
FIG. 1 shows the frontal view of a sliding sleeve produced using the method in accordance with the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The following considerations led to the present invention. The complex process steps using methods of prior art for producing a ring element with inner toothing, for instance a sliding sleeve according to FIG. 1 to 4, can be avoided if the ring element with inner toothing is produced by means of lateral extrusion.

FIG. 1 to 4 show a sliding sleeve 1 produced in accordance with the present method. The sliding sleeve 1 basically consists of an annular element 3 to which the individual axially running teeth elements 5 are formed on an inner toothing. On the outside, the body 3 may exhibit annular gear switching protrusions 7 that are interspaced from the sliding sleeve 1 in an axial direction and allow the sliding sleeve 1 to shift in an axial direction. These gear switching protrusions could be produced for instance by means of a metal cutting procedure.

Figure 2:
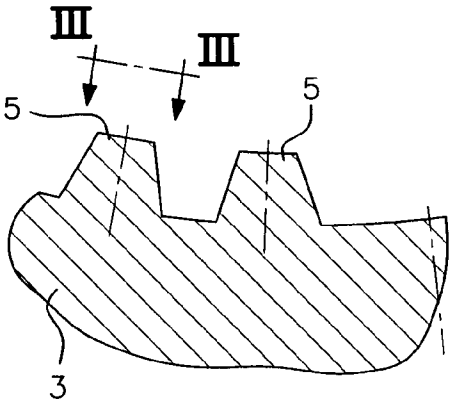
FIG. 2 shows an enlarged view of a section II—II in circumferential direction of two neighboring teeth of the inner toothing.
Figure 3:
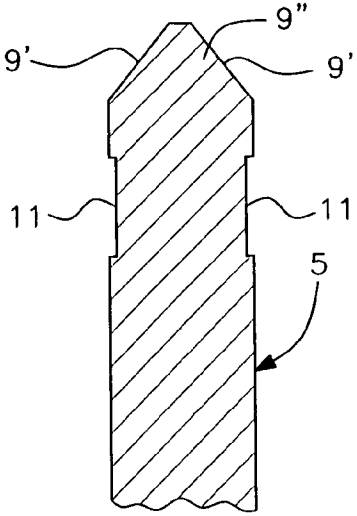
FIG. 3 shows a longitudinal top view of part of a section of a tooth of the inner toothing.
Figure 4:
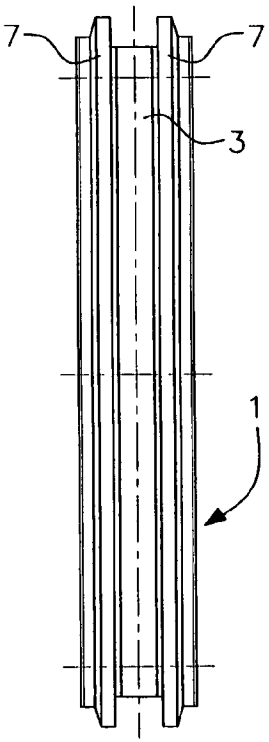
FIG. 4 shows a side view of the sliding sleeve shown in FIG. 1 produced using the method in accordance with the present invention.

FIG. 2 shows a section II—II in a circumferential direction through two neighboring toothing elements 5 of FIG. 1. FIG. 3 shows in section a part of the top view III—III of a tooth element 5. It can be seen that the front of each tooth element 5 has two lateral bevels 9' and one bevel 9" running inwards and upwards. When the sliding sleeve 1 is slid into the lengthwise toothing (key slots) of a sleeve not shown here, these bevels 9' and 9" serve as a so-called insertion bevel. As shown in FIG. 3, the toothing elements 5 may possess undercuts 11 that serve gear switching purposes.

The outlet ring element 10 is in the form of a forged blank that has preferably been blasted and annealed.

Figure 6A:
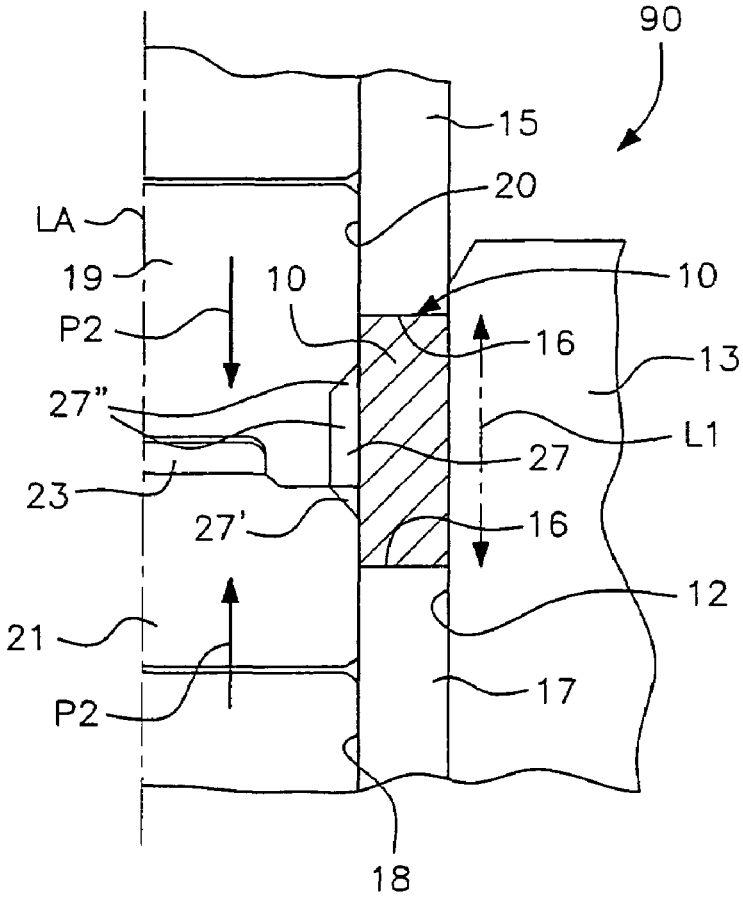
FIG. 6A shows a diagram of a lateral extrusion device for carrying out lateral extrusion for the production of the inner toothing according to the method of the present invention, wherein the state shown in this figure is before lateral extrusion has taken place.

As shown in FIG. 6A, the outlet ring element 10 is inserted into an extrusion device 90 that essentially consists of a matrix element 13 furnished with an inner bore hole 12 and a sleeve stamping device arranged therein comprising an upper sleeve stamping element 15 and a lower sleeve stamping element 17, and an inner stamping device comprising an upper inner stamping element 19 and a lower inner stamping element 21. The upper inner stamping element 19 and the lower inner stamping element 21 can be moved in an axial direction in a bore hole 20 of the upper sleeve stamp 15 and a bore hole 18 of the lower sleeve stamp 17. In the closed position, the upper inner stamping element 19 and the lower inner stamping element 21 form cavities 27 arranged next to each other in the circumferential direction, in which the individual toothing elements 5 of the inner toothing are produced during the extrusion process. In the closed position, the upper inner stamping element 19 and the lower inner stamping element 21 become meshed via a tooth system 23, which forces the upper inner stamping element 19 and the lower inner stamping element 21 to align exactly in the axial direction and especially also in the circumferential direction, so that in the closed position the aforementioned cavities 27 can be exactly formed when the partial regions 27', 27" are moved next to one another. Namely, when viewed in the axial direction, each cavity 27 consists of a first partial region 27' arranged in the lower inner stamping element 21 followed by a second partial region 27" arranged in the upper inner stamping element 19.

The cavity 27 between the upper inner stamping element 19 and the lower inner stamping element 21 is preferably divided in such way that the first partial region 27' serves to form a roof-shaped toothing 9', 9" of a tooth element 5 and the second partial region 27" serves to form a straight-cut tooth and the other roof-shaped toothing of the individual toothing elements 5 of the inner toothing. One advantage of this design is that during lateral extrusion, possible burrs do not develop in the area of the straight-cut toothing but at the transition between the straight-cut toothing and roof-shaped toothing, where an undercut is created later in a method explained in more detail down.

The annular pressing surfaces 16 of the upper sleeve stamping element 15 and the lower sleeve stamping element 17 run diagonally to the longitudinal axis LA of the extrusion device 90.

Figure 5:
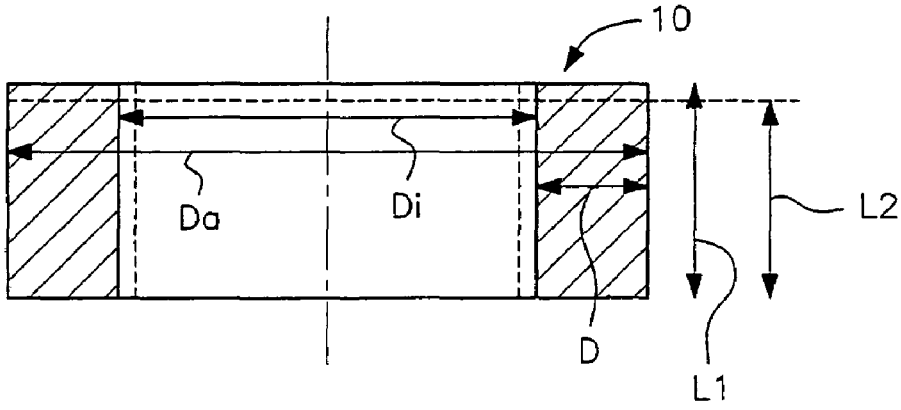
FIG. 5 shows a cross-section through an outlet ring element in accordance with the present invention for the production of a ring element with an inner toothing.

As shown in FIG. 5 it is assumed that when producing an annular element 1 comprising an inner toothing in accordance with the present invention, for instance a sliding sleeve, it is assumed that said annular element 1 has an outlet ring element 10 with an inner diameter Di, an outer diameter Da, a radial thickness D and an axial length L1. The dotted line in FIG. 5 shows the length L2 to which the outlet ring element 10 is shortened during the extrusion process, whereby the extruded material volume flows into the cavity 27 in order to form the toothing elements 5 of the inner toothing. This will be described in more detail below in connection with FIG. 6B.

The extrusion device 90 described above is processed in the following manner. First the outlet ring element 10 of FIG. 5 is inserted between the upper sleeve stamping element 15 and the lower sleeve stamping element 17 so that the annular pressing surfaces 16 of said sleeve stamping elements lie against the upper or lower front side of the outlet ring element 10. During this process, the inner stamping elements 19, 21 are closed or are already closed, whereby they are pressed against each other with the force P2 of hydraulic pre-tension, whereby the cavity 27 for the production of the toothing elements 5 is formed. The outer matrix element 13 preferably remains static in its position.

Figure 6B:
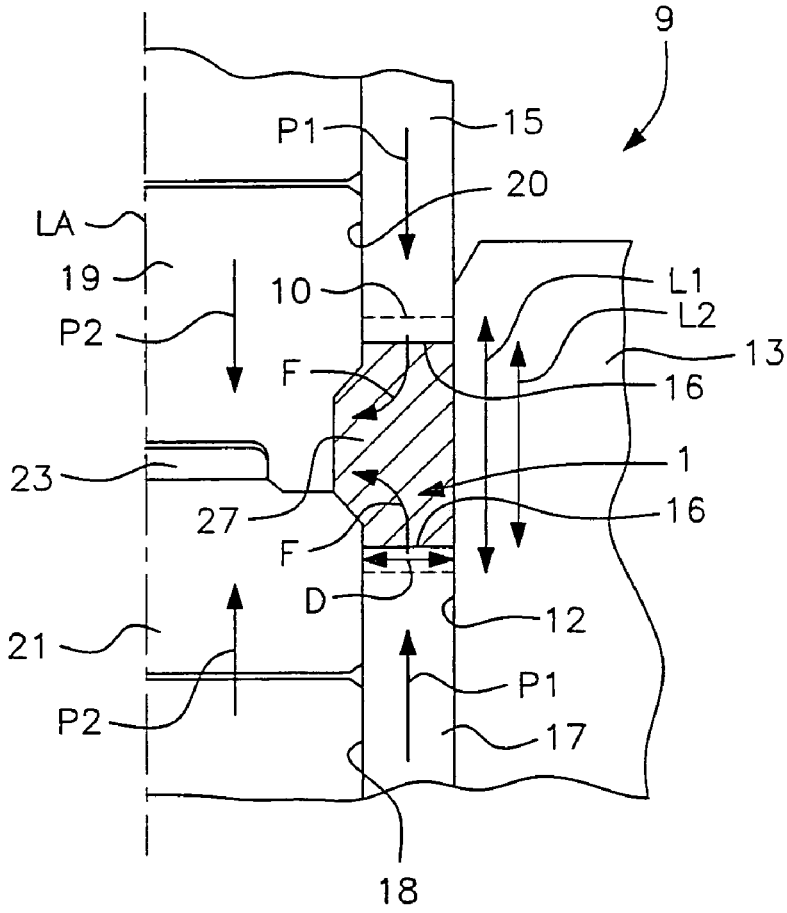
FIG. 6B shows the lateral extrusion device of FIG. 6A, wherein the state shown in this figure is after the lateral extrusion has taken place.

As shown in FIG. 6B, the inner stamping elements 15, 17 are now moved towards one another by a force P1, whereby the lower inner stamping element 17 preferably remains static in its position and the upper inner stamping element 15 is moved. In this process the length L1 of the outlet ring element 10 is shortened to the length L2 of the annular element 1, whereby the material volume of the outlet ring element 10 corresponding to said shortened length "flows" or is pressed in the direction of arrows F into the cavity 27 to form the toothing elements 5 of the inner toothing.

The extrusion can be executed at a temperature that is preferably between ambient temperature and approximately 1200° C., especially between about 1000° C. and 1200° C.

Since the extrusion causes an overflow of material and burrs, they will be removed by deburring. Phosphate layers and rust will be removed by means of debonders.

Figure 7:
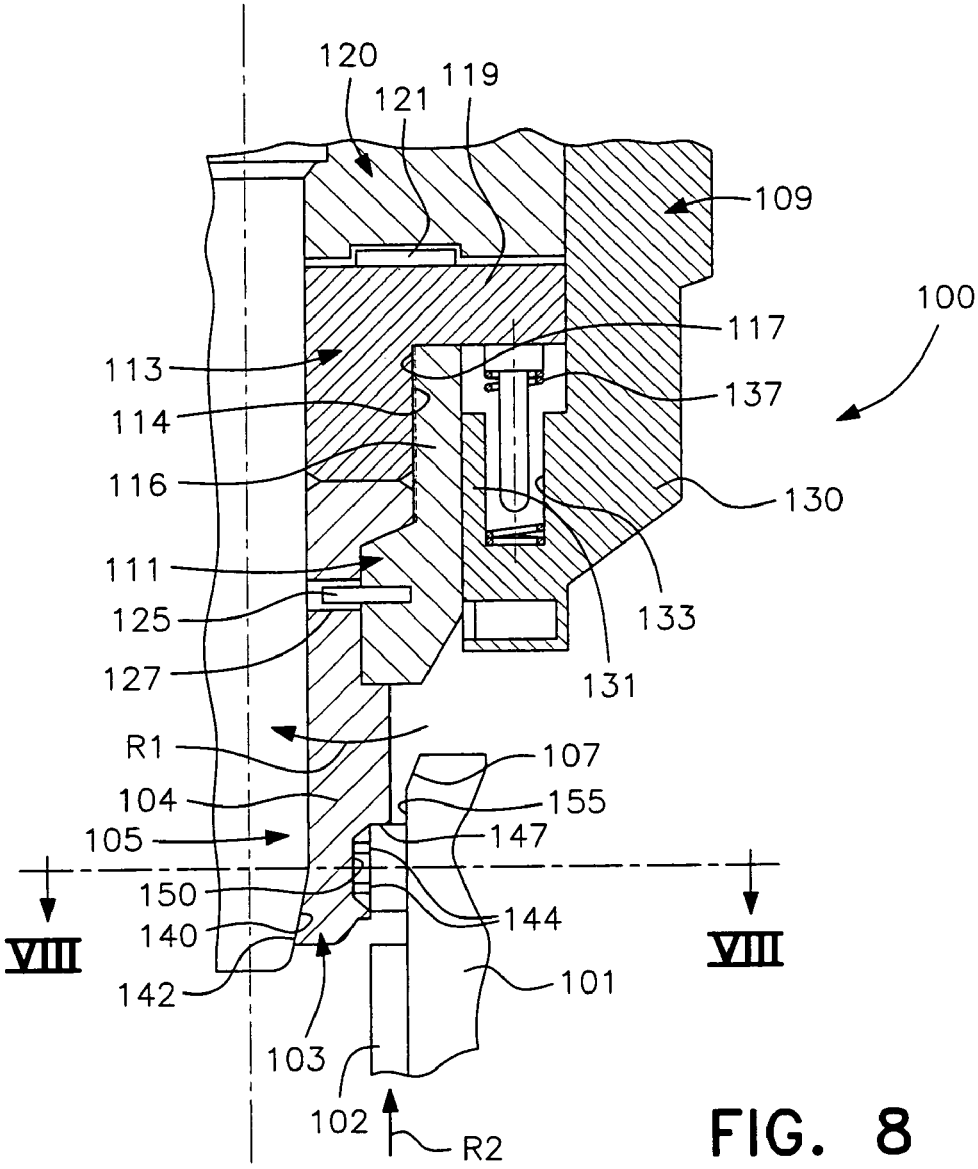
FIG. 7, 8 show an additional extrusion device for the production of at least one undercut in the toothing elements of the inner toothing according to an improvement of the method revealed in the present invention.

As shown in FIG. 3, the production of undercuts 11 in the toothing elements 5 of the inner toothing according to an improvement of the present method are explained in more detail below in connection with FIG. 7.

For this purpose an additional extrusion device 100 is used, said extrusion device 100 essentially consisting of a matrix element 101 with an ejector 102 and an ironing area 107, a stamping element 103 with multiple divisions in the circumferential direction that concentrically surround a die insert 105, and a pressing element 109.

Figure 8:
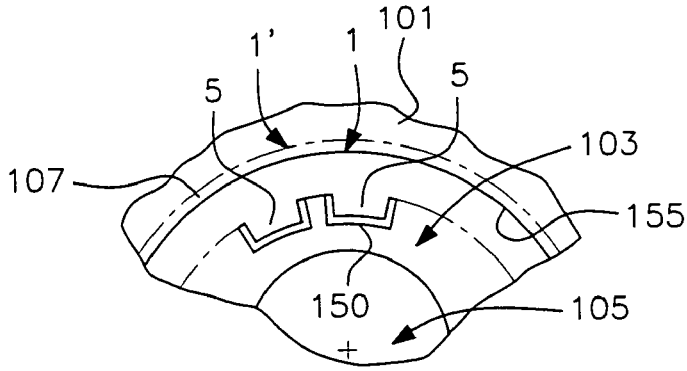
FIG. 8 shows an improvement of the invention.

The individual annulus elements 104 of the stamping element 103 arranged in the circumferential direction as shown in FIG. 8 can be moved in a radial direction. For this purpose the upper ends of said annulus elements that are turned away from the matrix element 101 can be moved radially and are positioned in a retainer ring element 111 that is in turn affixed in a annular element 113 surrounding the die insert 105 above the stamping element 103. The retainer ring element 111 with an internal thread 114 of a protruding area 116 jutting out axially above the stamping element 103 is preferably screwed together onto an external thread 117 of the annular element 113. On its side facing away from the matrix element 101, the annular element 113 features a flange element 119 protruding radially and overlapping with the protruding area, said flange element 119 being supported by a lateral annular element 120 surrounding the die insert 103, said lateral annular element running radially outwards from the die insert 103 and overlapping the flange element 120 radially. The flange element 119 and the lateral ring element 120 become meshed together by means of a radial toothing 121, that serves to precisely align the elements 119, 116, and 103 in the circumferential direction with regards to the elements 120 and 105 and to position them correctly.

The retainer ring element 111 is preferable provided with guide pins 125 running in a radial direction, that mesh into the corresponding radially running bore holes 127 of the upper area of the annulus element 104 of the stamping elements 103.

The outer surface of the lateral ring element 120 meshes into a bore hole of the already mentioned pressing element 109 and is affixed to the same, wherein an axial area 130 of the pressing element 109 runs axially downwards in the direction of the matrix element 101 and rests against the outer surface of the retainer ring element 111 with a flange area 131 protruding radially inwards, wherein the elements 111 and 130 can be moved against each other in an axial direction.

An energy storage 137 operates between the flange element 119 and the flange area 131, wherein said energy storage pushes parts 130 and 113 apart axially and preferably is in the form of a spring inserted in an inner bore hole 133 that opens towards the top of the flange area 131.

The die insert 105 comprises a bevel 140 that tapers conically towards its lower end, wherein said die insert is supported by corresponding beveled areas 144 of the annulus elements 104 of the stamping element 103, which run at an incline inward and outward as is explained in more detail below.

The lower end areas of the annulus elements 104 comprise protrusions 144 that protrude radially outwards in order to produce undercuts 11 in the grooves 150 that extend radially inward and run axially. A protruding shoulder 147 that interacts with the ironing area 107 in a way that will be explained in more detail below connects to each annulus element 104 in an axial direction on the side that faces the lateral ring element 120, i.e. upward.

The extrusion device described above is processed in the following manner. First a sliding sleeve 1 produced by means of the method described above, comprising an inner toothing is positioned on the matrix element 101 and is ironed during the lowering of the stamping element 103 together with the die insert and the elements 120, 109, 113, and 111 into the opening 155 of the matrix elements 101 via ironing area 107 that tapers conically inwards and downwards. This means that the annular body of the sliding sleeve 1 is thinned, whereby the outer diameter of the body, beginning at the lower end, is continuously decreased and the displaced material flows radially into the grooves 150 of the annulus elements 104 of the stamping elements 103, wherein said annulus elements are securely pressed against the die insert 105. To be more exact, the bevels 140 and 142 lie against one another.

In its circumferential direction, the sliding sleeve 1 is designed in such a way that one toothing element 5 is assigned to one groove 150 in which the undercuts 11 are produced, and that the transitional areas between two adjacent annulus elements 104 are arranged at such distances between two adjacent toothing elements 5 as to allow the annulus elements 104 to move radially.

In the ironing process, the material that flows into the grooves 150 assigned to the individual toothing elements 5 conforms to the shape of the protrusions 144 arranged in the grooves 150, which are the same shape as the undercuts 11 that are to be produced. As is shown in the diagram of FIG. 8 using the example of two toothing elements 5, the grooves 150 are measured with regard to the toothing elements 5 in such a way that they are able to accept the material that is displaced and flows into the grooves 150 during ironing on the beveled surface of the ironing area 107 as well as the material that is displaced at the protrusions 133.

Once the undercuts 11 are produced in the toothing elements 5, in order to remove the sliding sleeve 1 from the mold, the die insert 105 is pulled upwards together with the elements 120 and 109, wherein the bevels 140 and 142 separate from one another and the annulus elements 104 move radially inwards, as is shown by the arrow R1. The undercuts 11 are then released from the protrusions 144 and the stamping element 103 is caused to move abruptly upwards together with the elements 111 and 113 by the spring 133 that was previously biased by the downward motion of the die insert 105 and the elements 120, 119 130. The sliding sleeve 1 can then be ejected upward by the ejector 102 in the direction of the arrow R2.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A method for producing an annular element having an inner toothing, comprising:

arranging an outlet ring element in an extrusion device which includes an annular matrix element with an inner bore hole, a sleeve stamping device which is arranged therein and has a first and a second annular sleeve stamping element which can be moved in relation to each other in the inner bore hole, and an inner stamping device having a first and a second inner stamping element and first and second partial regions which are interspaced in the circumferential direction;

when the inner stamping device is closed, said partial regions forming cavities for producing the inner toothing; and the outlet ring element being arranged between the first and second inner stamping elements and measured in such a way that when closing the sleeve stamping device, material from the outlet ring element flows into the cavities for the formation of the inner toothing.

2. The method according to claim 1, wherein an element in the form of a forged blank is used as the outlet ring element.

3. The method according to claim 2, wherein the blank is blasted and annealed.

4. The method according to claim 1, wherein the first inner stamping element and the second inner stamping element have toothings that become meshed together so that the first inner stamping element and the second inner stamping element are brought into an exact axial and circumferential direction in relation to one another.

5. The method according to claim 1, wherein the first partial region is designed and used to form a straight-cut toothing and a roof-shaped toothing of a toothing element of the inner toothing, and a second partial region is designed and used to create a roof-shaped toothing of a toothing element of the inner toothing.

6. The method according to claim 1, wherein the outlet element is arranged between pressing surfaces of the first stamping element and the second stamping element, which are arranged transversely to a longitudinal axis.

7. The method according to claim 1, wherein the inner diameter, the outer diameter and the axial length of the outlet ring element are measured in such a way that when closing the sleeve stamping device, the outlet ring element is shortened on one end so that the material that is thereby displaced flows into the cavities.

8. The method according to claim 1, wherein when closing the sleeve stamping device, the position of the first sleeve stamping element or the second sleeve stamping device remains static in its position and the second sleeve stamping device or the first sleeve stamping device is moved.

9. The method according to claim 1, wherein the method is carried out while the temperature of the outlet ring element is between ambient temperature and approximately 1200° C.

10. The method according to claim 1, wherein the overflowing material and/or burrs created during the production of the annular element are removed by means of deburring.

11. The method according to claim 1, wherein phosphate layers and/or rust is removed from the annual elements by means of debonders.

12. An extrusion device comprising an annular matrix with an inner bore hole, a sleeve stamping device which is arranged therein and includes a first and a second annular sleeve stamping element which can be moved in relation to each other in the inner bore hole, and an inner stamping device having a first and a second inner stamping element and first and second partial regions which are interspaced in the circumferential direction;

said partial regions forming cavities for producing an inner toothing when the first and a second inner stamping elements of the inner stamping device are closed; and an outlet ring element being arranged between the first and second inner stamping elements and being measured in such a way that when closing the sleeve stamping device, material from the outlet ring element flows into the cavities for the formation of the inner toothing.

13. The device according to claim 12, wherein the first inner stamping element and the second inner stamping element have toothings that become meshed together so that the first inner stamping element and the second inner stamping element are brought into an exact axial and circumferential direction in relation to one another.

14. The device according to claim 12, wherein the first partial region is designed and used to form the straight-cut toothing and roof-shaped toothing of a toothing element of the inner toothing, and a second partial region is designed and used to create the upper toothing of a toothing element of the inner toothing.

15. The device according to claim 12, wherein the first sleeve stamping element and the second sleeve stamping element have pressing surfaces running transversely to the longitudinal axis, between which the outlet element can be arranged.

* * * * *